US007174685B2

(12) United States Patent
Hayes

(10) Patent No.: US 7,174,685 B2
(45) Date of Patent: Feb. 13, 2007

(54) POCKET FORMER FOR POST-TENSION ANCHOR

(75) Inventor: Norris Hayes, Sugar Land, TX (US)

(73) Assignee: Hayes Specialty Machining, Ltd., Sugar Land, TX (US)

( * ) Notice: Subject to any disclaimer, the term of this patent is extended or adjusted under 35 U.S.C. 154(b) by 101 days.

(21) Appl. No.: 10/357,076

(22) Filed: Feb. 3, 2003

(65) Prior Publication Data

US 2004/0148880 A1 Aug. 5, 2004

(51) Int. Cl.
*E04C 5/08* (2006.01)

(52) U.S. Cl. ..... 52/223.6

(58) Field of Classification Search ..... 52/223.13, 52/223.6, 223.14; 403/373, 374, 409.1; 254/134.3 FT
See application file for complete search history.

(56) References Cited

U.S. PATENT DOCUMENTS 3,685,934 A * 8/1972 Huber et al. ..... 425/111
3,956,797 A * 5/1976 Brandestini et al. ..... 52/223.13
4,773,198 A * 9/1988 Reinhardt ..... 52/223.13
5,072,558 A * 12/1991 Sorkin et al. ..... 52/223.13
5,271,199 A * 12/1993 Northern ..... 52/223.13
5,749,185 A * 5/1998 Sorkin ..... 52/223.13
5,755,065 A * 5/1998 Sorkin ..... 52/223.13
5,788,398 A * 8/1998 Sorkin ..... 403/300
5,897,102 A * 4/1999 Sorkin ..... 254/29 A
6,023,894 A * 2/2000 Sorkin ..... 52/223.8
6,027,278 A * 2/2000 Sorkin ..... 403/374.1
6,098,356 A * 8/2000 Sorkin ..... 52/223.13
6,381,912 B1 * 5/2002 Sorkin ..... 52/223.13
6,393,781 B1 * 5/2002 Sorkin ..... 52/223.13
6,631,596 B1 * 10/2003 Sorkin ..... 52/223.13
6,761,002 B1 * 7/2004 Sorkin ..... 52/223.13

* cited by examiner

*Primary Examiner*—A. Joseph Wujciak, III
(74) *Attorney, Agent, or Firm*—Alan T. Atkinson; Richard A. Fagin

(57) ABSTRACT

An apparatus and method for reducing corrosion in post-tension construction is described. An anchor is engagable with a post-tension tendon and comprises an anchor base and sheath engaged with the anchor base, and a cap for sealing the portion of the tendon within the anchor. The sheath can include an extension having a contact end distal from the anchor base for contacting the tendon as the tendon is inserted through the extension and the anchor base aperture. The cap can extend completely through the anchor base for connection to the anchor base of a sheath or sheath extension attached to the base. A pocketformer is attachable to the sheath for generating a void in concrete.

5 Claims, 2 Drawing Sheets

80
82
84
76
78

A
Added Bracket and lead line
60
58
54
52
44
48
50
56
62
70
32
88
34
30
86
42
36
40
38

74
64
66
72
68

POCKET FORMER FOR POST-TENSION ANCHOR

BACKGROUND OF THE INVENTION

The invention relates to the field of post tension systems for strengthening concrete. More particularly, the invention relates to an improved anchor and method for reducing corrosion on the wire strands of a post-tension tendon.

Mono-strand tendons typically comprise a seven wire strand cable or tendon placed within a plastic or elastomeric sheath. A seven wire tendon is formed with six wires helically wrapped around a central core wire.

Wire cable corrosion is a significant concern in post tension systems. Such corrosion occurs when water, salt and other corrosive agents contact the metallic tendon materials. Tendon failure typically occurs due to water intrusion into the interstices between the tendon and is typically concentrated at tendon ends or anchors.

Such failure also occurs at portions of the tendon damaged segments caused during installation. The installation of tendons typically occurs in a rugged construction environment where the tendons can be damaged by equipment, careless handling and contact with various site hazards. When the elastomeric sheath is punctured, a water leak path contacting the wire tendon is established. The puncture must be patched to resist water intrusion between the sheath and tendon. The puncture and patch can create a discontinuity between the tendon and the sheath, and this discontinuity can impede proper installation and performance of the tendon.

One conventional technique for providing extra protection in corrosive environments is to increase the thickness of the plastic sheath covering the tendon. A plastic sheath at least forty one-thousandths of an inch ("mils" thick can be formed around the tendon to resist abrasion and puncture damage. Although this approach provides incremental protection against leakage, a thicker sheath does not provide redundant protection to the tendon steel.

Another technique for providing extra protection in corrosive environments uses seals and grease-filled pockets for blocking water intrusion into the central tendon core. Oil or grease is pumped into the exposed tendon end to fill the interstices at the tendon ends, however this procedure does not protect the internal wire strands forming the tendon.

Another technique for resisting high corrosion environments is to specially coat or otherwise treat the individual wire strand with an electrostatic fusion-bonded epoxy to a thickness between one and five mils thick. Similar wire coating techniques use galvanized wire and other corrosion resistant wires within the multiple wire cables to form a corrosion resistant tendon. Significant effort has been made to create improved corrosion resistant materials compatible with the exterior sheaths and resistant to corrosion. Corrosion resistant materials typically have an affinity to metal and are capable of displacing air and water. Additionally, such materials are relatively free from tendon attacking contaminants such as chlorides, sulfides and nitrates. However, such tendons are expensive and the effectiveness of such corrosion resistant materials may not resist corrosion after the tendon is damaged.

Tendon corrosion typically occurs near the post-tension anchors because the outer sheath is removed from the wire tendon at such locations. To protect the bare wire from corrosion, protective tubes are connected to the anchor and are filled with grease or other corrosion preventative material. This conventional practice is demonstrated by different post-tension systems. For example, U.S. Pat. No. 5,271,199 to Northern (1993) disclosed tubular members and connecting caps for attachment to an anchor. U.S. Pat. No. 5,749,185 to Sorkin (1998) disclosed split tubular members for attachment to and anchor and for installation over the tendon. U.S. Pat. No. 5,897,102 to Sorkin (1999) disclosed a tubular member having a locking surface for improving the connection to an anchor, and a cup member and extension for engagement on the other side of the anchor. U.S. Pat. No. 6,027,278 to Sorkin (2000) and U.S. Pat. No. 6,023,894 to Sorkin (2000) also disclosed a tubular member having a locking surface to improve the connection to an anchor. U.S. Pat. No. 6,098,356 to Sorkin (2000) disclosed attachable tubular members filled with corrosion resistant grease.

A need exists for an improved post-tension seal for preventing fluid intrusion into the inner part of a post-tension anchor. The system should be compatible with existing installation procedures and should resist the risk of water intrusion into contact with internal tendon wires.

SUMMARY OF THE INVENTION

The invention provides an anchor and pocketformer for engagement with a post-tension tendon. The apparatus comprises an anchor base having a shaped aperture for permitting insertion of the tendon therethrough, a sheath engaged with the anchor base wherein said sheath includes a cylindrical extension having a contact end distal from the anchor base for contacting the tendon as the tendon is inserted through the cylindrical extension and the anchor base aperture, and a pocketformer detachably engagable with the sheath.

In different embodiments of the invention, the pocketformer can comprise a spindle and a pocketformer body engagable with the spindle. Either the spindle or the pocketformer can be attachable to the sheath, and the spindle can extend through the anchor base to provide a continuous path for insertion of the tendon therethrough.

DESCRIPTION OF THE PREFERRED EMBODIMENTS

The invention provides a unique system for providing a post tension system resistant to corrosion. Each tendon typically comprises an exterior sheath surrounding at least two strands formed with a material such as carbon steel.

Figure 1:
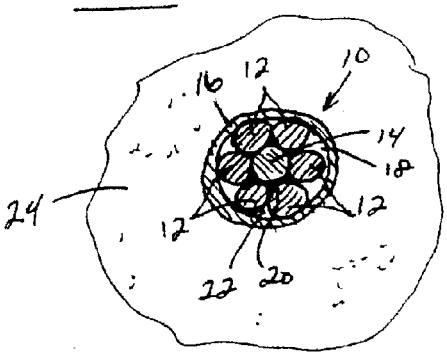
FIG. 1 illustrates a mono-strand cable enclosed with a first sheath.

FIG. 1 illustrates a sectional view wherein mono-strand wire tendon 10, formed with individual wire strands 12 about center wire 14, is positioned within first sheath 16. One or more wire strands 12 are helically wrapped about center wire strand 14 and form helical grooves on the exterior surface of cable 10. Such helical grooves are cumulatively identified as shaped annulus 18 defining the space between tendon 10 and the interior cylindrical surface of first sheath 16.

Because wire strands 12 are circular in cross-seciton, spaces between adjacent wire strands 12 and center wire 14 are cumulatively identified as cable interior interstices 20. As shown in FIG. 1, annulus 18 and interstices 20 are filled with corrosion resistant material 22. Grease or another suitable material can be used for corrosion resistant material 22 to eliminate air pockets and to resist water intrusion into contact with wire strands 22. By filling annulus 18 with a lubricant or corrosion resistant material 22, the interior surface of first sheath 16 can be substantially cylindrical in one embodiment of the invention.

Figure 2:
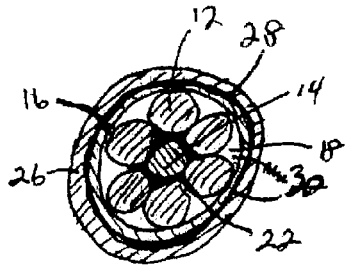
FIG. 2 illustrates a second sheath.
Figure 3:
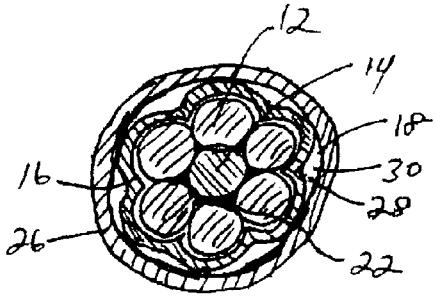
FIG. 3 illustrates a first sheath closely formed to the cable exterior surface.

FIGS. 2 and 3 illustrate second sheath 26 formed about first sheath 16. Annulus 28 is formed between second sheath 26 and first sheath 16 and is filled with a lubricant 30 to facilitate sliding movement therebetween. Lubricant 30 can comprise a corrosion resistant material similar to material 22. Grease or another lubricant is place on the outer surface of the seven strand wire tendon adjacent to the elastomeric sheath to resist corrosion created by air and water infiltration between the tendon and the sheath. In FIG. 2 annulus 28 is substantially cylindrical. In FIG. 3 first sheath 16 is tightly formed about the exterior surface of tendon 10 and helical grooves, filled with corrosion resistant material, are formed in the exterior surface of first sheath 16. This feature preferably uses a material for first sheath 16 having a thickness less than ten mils. Conventional membranes are typically twenty-five mils thick for regular systems and forty mils thick for high corrosion resistant, encapsulated systems. By providing a slim first sheath 16 about tendon 10 which is capable of fitting tightly about tendon 10 to create grooves in the exterior surface of first sheath 16, corrosion resistant material 30 can be stored in annulus 28 to resist intrusion by water of other contamination into contact with first sheath 16 or tendon 10.

Figures 4, 5, 6:
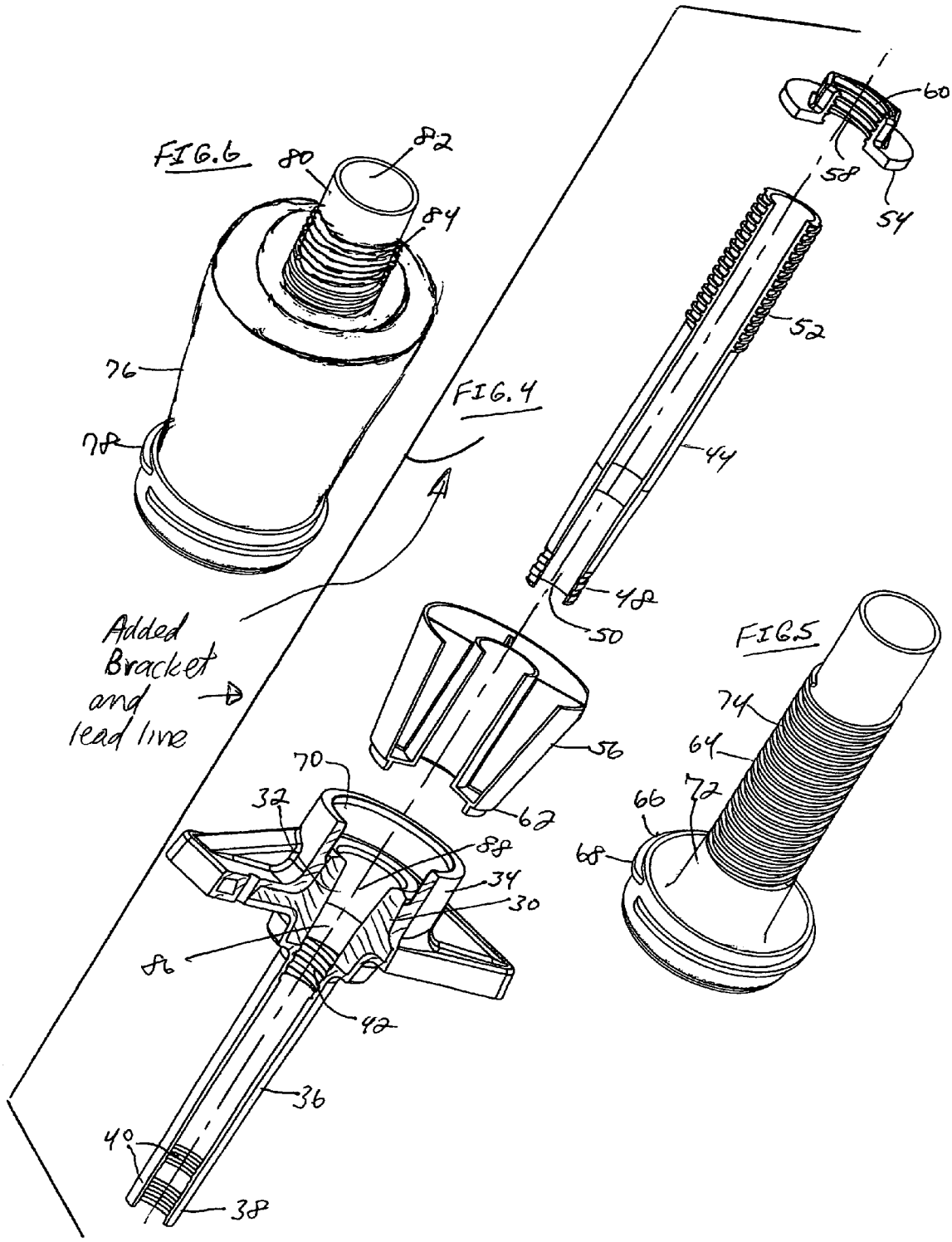
FIG. 4 illustrates an exploded view of a base, spindle, pocketformer and retainer cap.
FIG. 5 illustrates a cap and spindle directly attachable to a base sheath.
FIG. 6 illustrates a pocketformer integrated with a spindle.

FIG. 4 illustrates post-tension anchor comprising base 30 having shaped aperture 32. Base 30 is formed with a cast metal material suitable for handling large compressive loads. Sheath 34 is attached to base 30 and includes cylindrical extension 36 having a contact end 38 distal from base 30. Contact end 38 is preferably at least four inches distal from base 30, however shorter or longer lengths are possible within the usable scope of the invention. The inner surface of contact end 38 is preferably circular in cross-section for contacting the exterior surface of tendon 10 as tendon 10 is inserted through cylindrical extension 36 and base aperture 32. Seal 40 can be positioned between contact end 38 and tendon 10 to restrict liquid intrusion into the inside of cylindrical extension 36.

FIG. 4 illustrates one embodiment of the invention in expanded form wherein extension 36 includes threadform 42 proximate to base 30. Spindle 44 is attachable to threadform 42 with threadform 48 formed on a first end of spindle 44. By inserting spindle 44 completely through anchor base 30, a continuous path is created for insertion of tendon 10 therethrough.

Spindle 44 can be substantially shaped as a cylinder having hollow interior 50 for receiving tendon 10 therethrough, however other shapes can be used to accomplish the function described herein. A second end of spindle 44 has threadform 52 for connection to cap 54. Cap 54 can provide the function of locking pocketformer 56 onto spindle 44 and can have aperture 58 therethrough for permitting withdrawal of tendon 10 therethrough. Threadform 60 provides rotatable engagement with threadform 52. In another embodiment of the invention cap 54 can be closed to seal the interior of spindle 44 from entry of contaminants into hollow interior 50.

In the inventive embodiment shown in FIG. 4, a locked connection between extension 36 and spindle 44 is accomplished without requiring threads or other connector within base 30. This feature of the invention saves time in the field by permitting quick installation and detachment while eliminating the need for expensive milling of threads into the metallic components of base 30. This feature of the invention also permits factory assembly of corresponding components before such components are shipped to the field for installation.

Seal end 62 of pocket former 56 can be shaped to provide a tight fit with sheath 34. Preferably such fit can be configured so that engagement of cap 54 urges pocketfomer 56 into a fluid tight seal with sheath 34. Alternatively, a seal (not shown) can be inserted therebetween.

FIG. 5 illustrates another embodiment of the invention wherein spindle 64 has an enlarged first end 66 having threadform 68 for rotational engagement with threadform 70 in sheath 34 as shown in FIG. 4. Cylindrical body 72 of spindle 64 includes threadform 74 for engagement with cap 54 to secure pocketformer 56 as described for FIG. 4. This embodiment of the invention provides for spindle 64 to be attached directly to sheath 34 without modifying the configuration of body 30.

In another embodiment of the invention as shown in FIG. 6, spindle and pocketformer can be integrated into a single component shown as pocketformer 76 having threadform 78 for rotatable engagement with sheath 34, spindle section 80 having aperture 82 for permitting passage of tendon 10 therethrough, and threadform 84 on an exterior surface of spindle section 80 for engagement with sealing cap 54. Cap 54 can selectively provide a seal for closing aperture 82 from fluid intrusion. Alternatively, threadform 84 can provide a connection for an extension tube (not shown) similar to extension 36 extending to a location distal from base 30.

Referring to FIG. 4, spindle 44 is capable of extending through base 30 because of the unique formation of shaped aperture 32 therethrough. In one embodiment of the invention as illustrated, shaped aperture 32 can comprise an aperture having a compound surface having at least two different surfaces with different shapes or angles relative to the longitudinal axis illustrated. Surface 86 comprises a truncated conical surface at an angle two degrees from the longitudinal axis. Although such angle is two degrees, the angle can be changed to range between two and five degrees within the scope of the invention. Surface 88 comprises a truncated conical surface seven degrees from the longitudinal axis or centerline, which is the standard angle used in the industry from wedges. The combination of multiple surfaces 86 and 88 permits a larger aperture size to be created through anchor base 30, thereby permitting the insertion of spindle 44 therethrough. Such configuration continuously enlarges the size of the aperture, thereby preventing restrictions which might impede insertion of tendon 10 therethrough.

Figure 7:
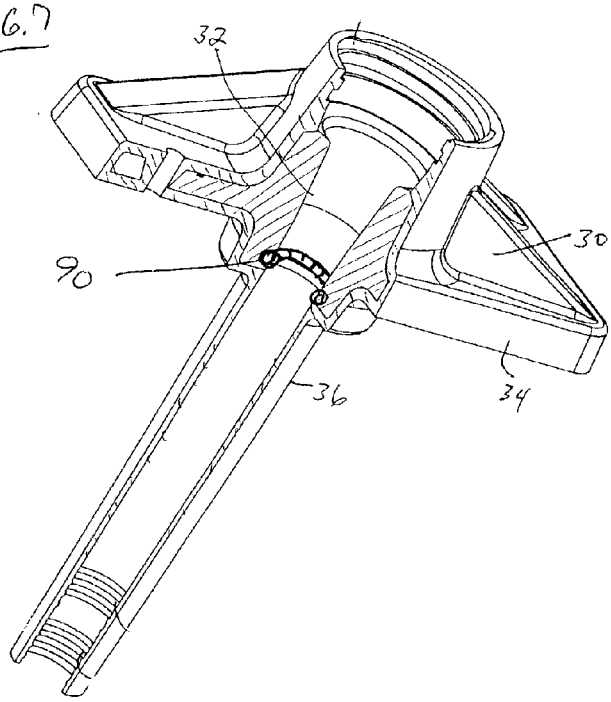
FIG. 7 illustrates a sheath cutter.

FIG. 7 illustrates another embodiment of the invention wherein sheath cutter 90 is integrated within anchor base 30 for the purpose of stripping either sheath 16 or sheath 26 or both (if present). By locating cutter 90 in such position, the outer sheath of tendon 10 is automatically stripped as tendon 10 is inserted through base 30. This feature of the invention dramatically saves installation time and results in a cleaner sheath cut than typically possible in field installations. Various configurations of such cutter are possible, permitting the partial or complete removal of sheath material from the end or middle section of tendon 10.

The invention provides superior anti-corrosion protection through the entire tendon length, and especially around the point of engagement with post-tension anchors. The sheath materials can be selected from material classes such as nylon, polymers, metals, or other organic or inorganic or mineral or synthetic materials. An outer second sheath can be formed with a tough material resistant to punctures and stretching damage, while an interior first sheath can be formed with another material for retaining the corrosion resistant material.

The configuration of base 30 permits installation and tensioning of tendon 10 without removal of sheath 16 from tendon 10 at the location of base 30. By avoiding substantial disturbance of the manufactured sheath 16, the most sensitive pint of corrosion is completely eliminated. The configuration of the caps and pocket formers described in cooperation with base 30 significantly reduces labor time and cost and provides superior reliability during installation. Such reliability reduces field damage to post tension components and the possibility of corrosion resulting from such damage, and eliminates the need to costly and unreliable field repairs.

Although the invention has been described in terms of certain preferred embodiments, it will become apparent to those of ordinary skill in the art that modifications and improvements can be made to the inventive concepts herein without departing from the scope of the invention. The embodiments shown herein are merely illustrative of the inventive concepts and should not be interpreted as limiting the scope of the invention.

What is claimed is:

1. An anchor for engagement with a post-tension tendon, comprising:

an anchor base having a shaped aperture for permitting insertion of the tendon therethrough;

a sheath engaged with the anchor base, the sheath including a cylindrical extension having an inner and outer surface and a contact end distal from the anchor base for contacting the tendon as the tendon is inserted through the cylindrical extension and the anchor base aperture;

a pocketformer detachably engaged with the sheath, the pocketformer comprising a spindle and a body having an aperture for permitting passage of the spindle therethrough; and wherein the spindle is extendible through the anchor base aperture and is attachable to the interior surface of the sheath extension to provide a continuous path for insertion of the tendon through the spindle.

2. The anchor of claim 1 further comprising a corrosion resistant material positioned within the cylindrical extension.

3. The anchor of claim 1 wherein the sheath encapsulates substantially all of the anchor base.

4. The anchor of claim 1 further comprising a cap attachable to the spindle for locking the pocketformer body to the spindle.

5. The anchor of claim 4, wherein the cap is capable of sealing the aperture.

* * * * *